US008172158B1

(12) United States Patent
Burkhardt et al.

(10) Patent No.: US 8,172,158 B1
(45) Date of Patent: May 8, 2012

(54) FLANGEWAY FORMER AND RAIL BOOT SYSTEM

(75) Inventors: Bruce Burkhardt, Conestogo (CA); Bradley W Bedford, Guelph (CA); Rick Ellis, Kitchener (CA)

(73) Assignee: Polycorp, Ltd., Elora (CA)

( * ) Notice: Subject to any disclaimer, the term of this patent is extended or adjusted under 35 U.S.C. 154(b) by 206 days.

(21) Appl. No.: 12/541,708

(22) Filed: Aug. 14, 2009

Related U.S. Application Data

(60) Provisional application No. 61/089,454, filed on Aug. 15, 2008.

(51) Int. Cl.
*E01B 1/00* (2006.01)

(52) U.S. Cl. ..... 238/8; 238/2

(58) Field of Classification Search ..... 238/2–9, 238/17, 121, 122, 140, 143, 147; 246/456, 246/457, 460
See application file for complete search history.

(56) References Cited

U.S. PATENT DOCUMENTS 5,609,294 A * 3/1997 Lucas, Jr. ..... 238/9
6,068,195 A * 5/2000 Gaudet ..... 238/8
6,129,288 A * 10/2000 Petersen et al. ..... 238/8
6,293,473 B1 * 9/2001 Ortwein et al. ..... 238/2
6,296,195 B1 * 10/2001 Blank et al. ..... 238/2
6,588,677 B2 * 7/2003 Hofstetter et al. ..... 238/283
6,726,116 B2 * 4/2004 Hofstetter, Sr. ..... 238/8
7,484,669 B2 * 2/2009 Gray, Jr. ..... 238/3
7,677,465 B1 * 3/2010 Bruning ..... 238/8
2003/0098359 A1 * 5/2003 Hofstetter Sr. et al. ..... 238/109
2003/0168519 A1 * 9/2003 Hofstetter, Sr. ..... 238/8
2005/0023366 A1 * 2/2005 Williams et al. ..... 238/264
2011/0084175 A1 * 4/2011 Naquin ..... 246/415 R

OTHER PUBLICATIONS

Polycorp, Boot and Cap for Ri57 Girder Rail, Drawing No. RA-4057-1C, Feb. 23, 2006.

* cited by examiner

*Primary Examiner* — S. Joseph Morano
*Assistant Examiner* — Jason C Smith
(74) *Attorney, Agent, or Firm* — Bradley Arant Boult Cummings, LLP; Nicholas Landau; Nathan Johnson

(57) ABSTRACT

A flangeway former and rail boot system where the flangeway former has an anchor for anchoring the former in surrounding material, and a groove for receiving a protrusion on the rail boot for positioning the former on the boot. The system can also include a spacer and retaining clips.

17 Claims, 3 Drawing Sheets

FLANGEWAY FORMER AND RAIL BOOT SYSTEM

CROSS-REFERENCE TO RELATED APPLICATIONS

This application claims the benefit of U.S. Provisional Patent Application Ser. No. 61/089,454 filed Aug. 15, 2008.

FIELD OF THE INVENTION

The present invention relates to railway track assemblies in general, and a system for securing a flangeway former and a rail boot for installation in particular.

BACKGROUND OF THE INVENTION

Rail beds must often cross a roadway or a pedestrian walkway at grade level or be built within the same roadway. At such intersections and locations, the recessed areas of the rail bed are often built up so that the surface of the road or walkway is at the same level as the top surface of the rails, with the exception of the recesses provided adjacent to the rails to accommodate the rail car wheels.

To accomplish this type of shared right-of-way construction, the recessed areas on either side of the rails are often filled with road bed material, such as poured concrete. However, because the rails are often used as signal conductors or negative returns for the railcar's power traction, they must be substantially electrically isolated from the ground. Electrical isolation also functions to inhibit the corrosion of the rails and underground utilities. Rail boots and flangeway formers also provide vibration isolation to extend concrete life and to reduce noise generated by the trolleys.

For this reason, many transit systems use an extruded flangeway former in combination with a rail boot to improve the electrical isolation of the rail. This also eliminates the need to form a flangeway in the road surface. However, prior art systems do not effectively secure the flangeway formers in the proper position during installation while the concrete is poured and cured.

Once installed, there can be a tendency for the flangeway former to shift during installation due to pressure from the road bed material as the area around the flangeway and rail boot is filled. Conventional flangeways also have a tendency over time to pull away from the road bed material towards the rail following installation most commonly from dirt penetrating the seam between the road bed material and the flangeway former. Such shifting of the flangeway former reduces the width of the flangeway, resulting in damage to the flangeway former by rail wheels running in the flangeway. The flangeway former can also shrink along its length, resulting in gaps between adjacent lengths of flangeway material.

SUMMARY OF THE INVENTION

In one embodiment, this invention facilitates the installation of a flangeway former and rail boot by securing the flangeway former and rail boot in the desired position along the length of the flangeway former, with proper flangeway dimensions, and with a good fit to the rail boot. The flangeway former and rail boot at the top are held in place by a spacer which helps prevent shifting of the flangeway former and rail boot when poured concrete, rolled asphalt or other road bed material exert pressure on the former and rail boot. The spacer is removed after installation of the former and rail boot and this facilitates the removal of concrete, asphalt, or other construction materials that happen to fill a channel of the spacer placed in the flangeway during installation.

In another embodiment, this invention relates to a flangeway farmer suitable for use with a rail boot comprising a body having a first side for engaging the rail boot along a length of the rail, and a groove in the first side adapted to receive a protrusion on the rail boot adjacent the base of the boot to position the former on the rail boot.

The flangeway former preferably has a flange for abutting the rail boot adjacent the top of the rail, and further has at least one tab protruding laterally from the flangeway former away from the rail for securing the flangeway former in road bed material. Preferably, each tab has at least one anchor, which is preferably located at a distal end each tab, for securing each tab in road bed material.

In another embodiment, this invention relates to a flexible rail boot clip in the shape of a rail base which clips both sides of the rail base. The rail boot clip comprises a first bracket for receiving the rail boot at the base of the rail on the field side, a second bracket for receiving the rail boot at the base of the rail on the gauge side and contacting the flangeway former, and a fastener for connecting the first bracket and the second bracket for securing the brackets on the boot. The fastener can be an elastic band, a tie wrap, a bungee cord, a twine, or a similar material.

In another embodiment, this invention relates to a flangeway former and rail boot system for a rail comprising a flangeway former for forming a flangeway adjacent the rail, a rail boot adapted to conform to the rail, and the flangeway including a groove near the base of the flangeway former and the rail boot including a protrusion whereby when the groove receives the protrusion, the flangeway former is positioned in a desired location adjacent to the rail.

The system preferably further includes an extruded form having a first arm and a second arm, the first arm for holding the rail boot in place on the field side of the rail, and the second arm for holding the flangeway former in place on the gauge side of the rail.

Preferably, the system further includes at least one rail boot clip comprising a first bracket for receiving the rail boot at the base of the rail on the field side, a second bracket for receiving the rail boot at the base of the rail on the gauge side and contacting the flangeway former, and fastening means for connecting the first bracket and the second bracket for securing the brackets on the base of the rail boot.

In another embodiment, the invention relates to a spacer for spacing a rail boot comprising a top, and a former comprising a top, relative to a rail, the spacer comprising a strip comprising three contiguous channel segments wherein the first and third segments are oriented in the same direction and the second segment is situated between the first and third segments and is oriented in a direction opposite to the first and third segments; at a first end of the strip, the outside arm of the first segment defining a retaining arm for retaining the top of the rail boot, and at a second end of the strip, the outside arm of the third segment defining a retaining arm for retaining the top of the former.

In a further embodiment, the invention relates to a retaining clip for retaining a rail boot on a rail comprising a first channel section for receiving a first section of the base of the rail, a second channel section contiguous with the first channel section but oriented in a direction opposite to the first channel section. The retaining clip can further comprise an arm extending from the outside wall of the first channel and adapted for retaining a flangeway.

In a still further embodiment, the invention relates to a retaining clip system comprising two retaining clips and a fastener for engaging the second channels for retaining the retaining clips on a rail boot.

BRIEF DESCRIPTION OF THE DRAWINGS

The invention is described in greater detail with reference to the accompanying drawings, which illustrate an embodiment of this invention, and wherein.

DETAILED DESCRIPTION OF THE INVENTION

Figure 1:
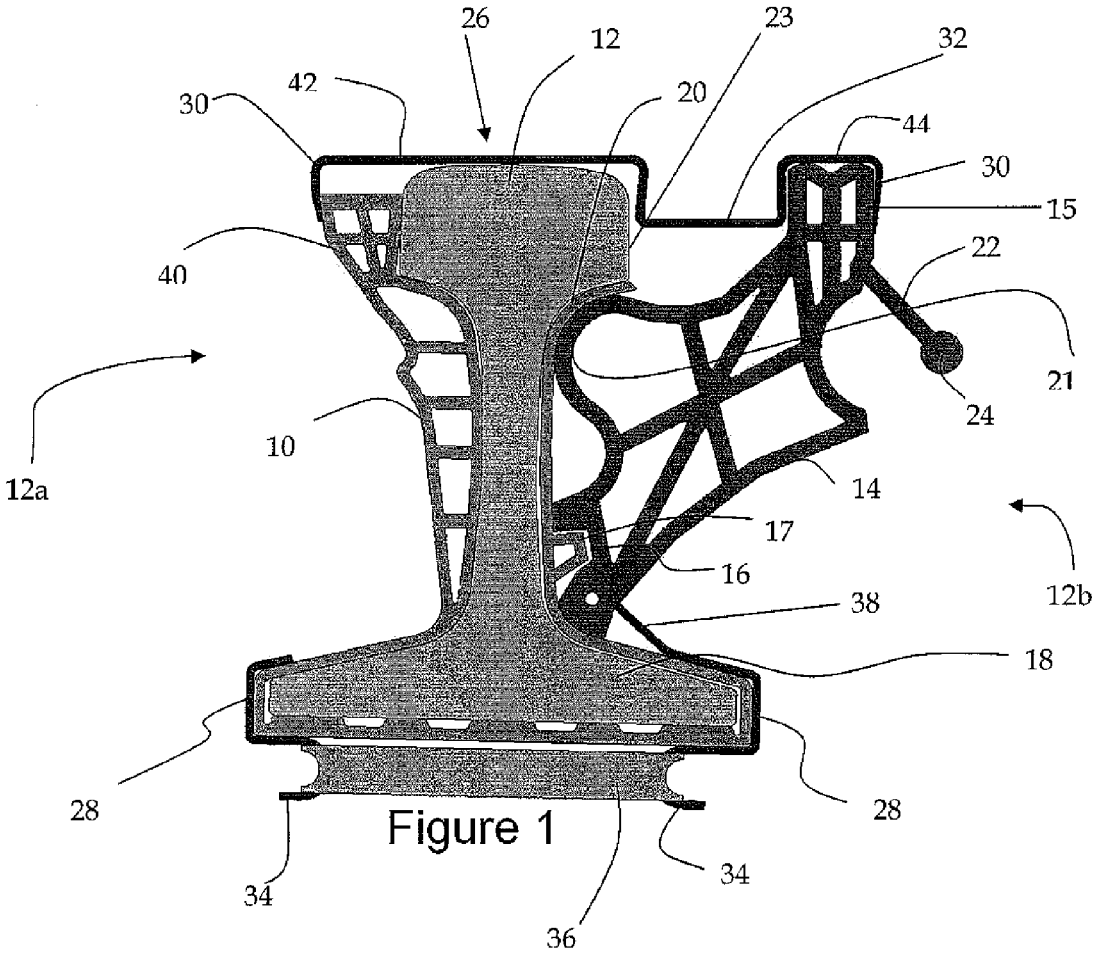
FIG. 1 is an end view of a flangeway system in accordance with one embodiment of this invention.

Referring to FIG. 1, an insulating rail boot 10 is shown encasing a rail 12. The rail has a gauge side and a field side as the terms are commonly used in the art. In the embodiment of FIG. 1, the outside of the rail 12 will be referred to as the field side, being the left half of FIG. 1 indicated generally at 12*a*. The inside of the rail 12 will be referred to as the gauge side, being the right half of FIG. 1, indicated generally at 12*b*.

The rail boot 10 is assembled to the rail 12 in association with a flangeway former 14.

The flangeway former 14 preferably has a groove 16 near the base of the flangeway former 14 for receiving a protrusion 17 on the side of the rail boot 10 adjacent the flangeway former 14. Preferably, the protrusion 17 is located near the base 18 of the rail boot 10.

The protrusion 17 is preferably generally trapezoidal in cross-sectional profile. However, the protrusion 17 can take other shapes such as a generally bulbous cross-sectional profile. It will be understood by a person skilled in the art that the shape of the groove 16 complements the shape of the protrusion 17.

The fit of the protrusion 17 in the groove 16 is such that it is not so tight that it is difficult to install, but not so loose that it does not serve to securely position the flangeway former 14 against the rail boot 10.

The flangeway former 14 preferably also has a rounded flange 21 for abutting the rail boot 10 at the concave surface 20 near the rail head 23.

When the flangeway former 14 is fitted to the rail boot 10 such as during installation, the protrusion 17 of the rail boot 10 is positioned in the groove 16 of the flangeway former 14 and the flange 21 abuts the concave surface 20 to position the flangeway former 14 at the gauge side 12*b* of the rail boot 10.

The flangeway former 14 preferably also has at least one tab 22 that protrudes from the flangeway former 14 preferably from near the top 15 of the flangeway 14. The tab 22 should be positioned on the flangeway former 14 such that it will be embedded in the road bed material once the area on the gauge side 12*b* of the system is filled with road bed material. Preferably, there are numerous tabs along the entire longitudinal length of the flangeway former 14. The tab 22 preferably has at least one anchor 24 that helps stabilizes the tab 22 into the surrounding road bed material. The anchor 24 is located at the distal end of the tab 22 and is bulbous. Other suitable shapes such as cubes can be used for the anchor. The anchor can also be located at other locations along the tab and more than one anchor per tab can be used.

The general shape of the flangeway former 14 can be similar to conventional flangeway formers. Accordingly, a person of ordinary skill in the art would understand that the shape of the flangeway former 14 can vary. However, flangeway formers according to this invention include a protrusion/groove arrangement as exemplified by the protrusion 16 and the groove 17, and/or a tab as exemplified by the tab 22. Both the exemplified rail boot 10 and exemplified flangeway 14 former include web structures as shown in the Figures.

In one embodiment, the rail boot 10 and the flangeway former 14 are secured in place against the rail 12 by a spacer indicated generally at 26 and a rail boot retaining clip 28.

However, to prevent the flangeway former 14 from shifting closer towards the rail during a concrete pour, the spacer 26 also has a channel 32 located near the arm that secures the flangeway former 14 to the rail 12 to hold the flangeway former 14 away from the rail 12 at the desired position during the addition of road bed material. The spacer also has two channels 42 and 44 on either side of the channel 32 which are oriented in a direction opposite to channel 32. The spacer 26 has two arms 30 that secure the top 40 of the boot 10 and the top 15 of the flangeway former 14 against the field side and gauge side of the rail 12 respectively during installation.

Instead of multiple spacers 26 which are relatively short in length (the length being along the longitudinal axis of the rail when the spacer 26 is installed), extruded forms of longer length can be used. With forms of longer length, longer sections of the flangeway can be covered by the spacer 26 during installation. Material falling into the flangeway during installation will fall into the channel 32 and can easily be removed with the spacer 26 when the form is removed from the rail 12 following installation. The spacers 26 can also be used to keep the flangeway clean during construction, or when components of the system need to be held in their proper position. The spacer 26 can also be reused but it is not essential that it be reusable.

The rail boot retaining clip 28 generally takes the form of the rail base 18 and is assembled over the rail boot 10. The rail boot retaining clip 28 tightly forms the rail boot 10 around the rail base 18 to overcome distortions that may occur during packaging and shipping. The rail boot retaining clip 28 can be made of suitable material such as rigid plastic, rubber, sheet metal, or small diameter round metal profiles.

In one embodiment of this invention as shown in FIG. 1, the rail boot retaining clip 28 has a bracket 34 on both the field side and the gauge side of the rail base 18. The two brackets 34 are joined by a fastener 36 in a manner that holds the rail boot retaining clip 28 tightly against the rail boot 10. The fastener 36 can be an elastic band, tie wrap, bungee cord, twine, or similar material.

In the embodiment shown in FIG. 1, the rail boot retaining clip 28 has an extended finger 38 on the bracket 34 on the gauge side that further anchors the base of the flangeway former 14 against the gauge side of the rail boot 10.

In another embodiment of this invention, the field side of the rail boot retaining clip 28 may also be extended to further anchor the rail boot 10 to the rail 12.

In yet another embodiment of this invention, two rail retaining boot clips and a fastener can be formed of one piece or several pieces more or less permanently connected to form a single system. The flexible material for the system can be rubber, plastic, or another suitable material.

Figure 2:
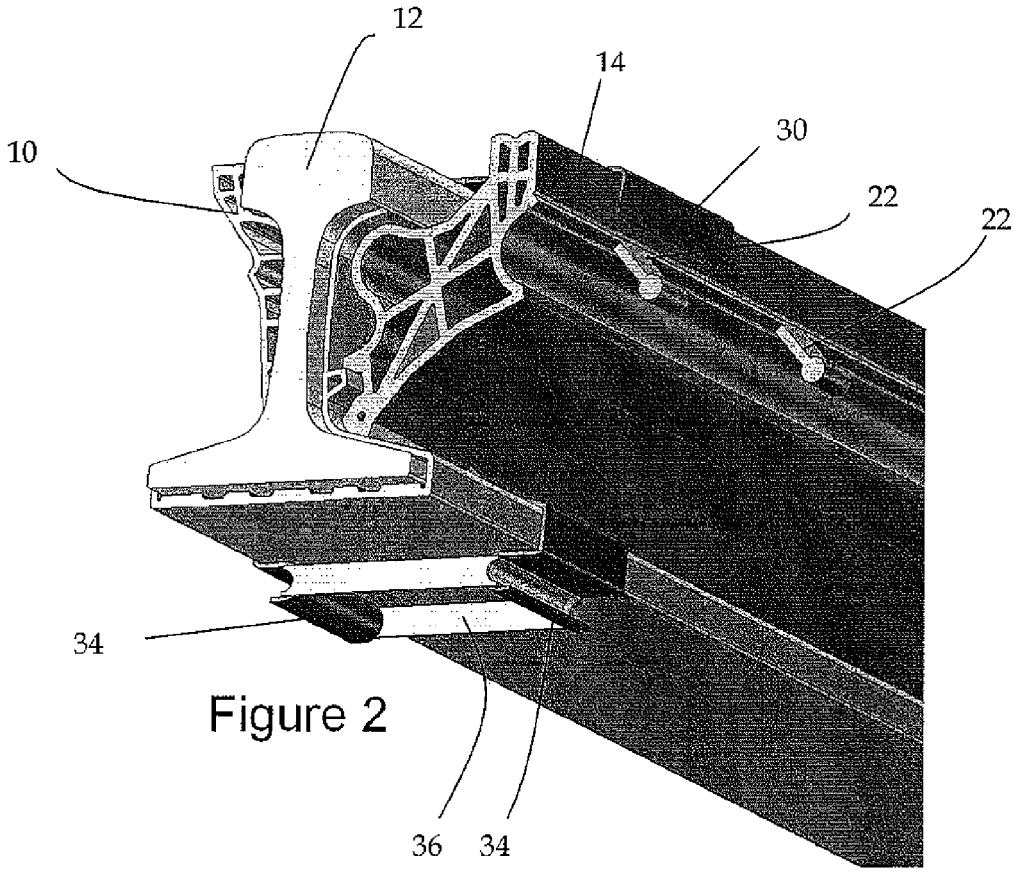
FIG. 2 is an isometric perspective bottom view of the flangeway system in accordance with one embodiment of the present invention.

FIG. 2 shows a perspective bottom view of the flangeway system. In FIG. 2, the two brackets 34 of the rail boot clip 28 are secured by a thick elastic band. The span of the rail boot clip 28 along the length of the rail may vary.

Figure 3:
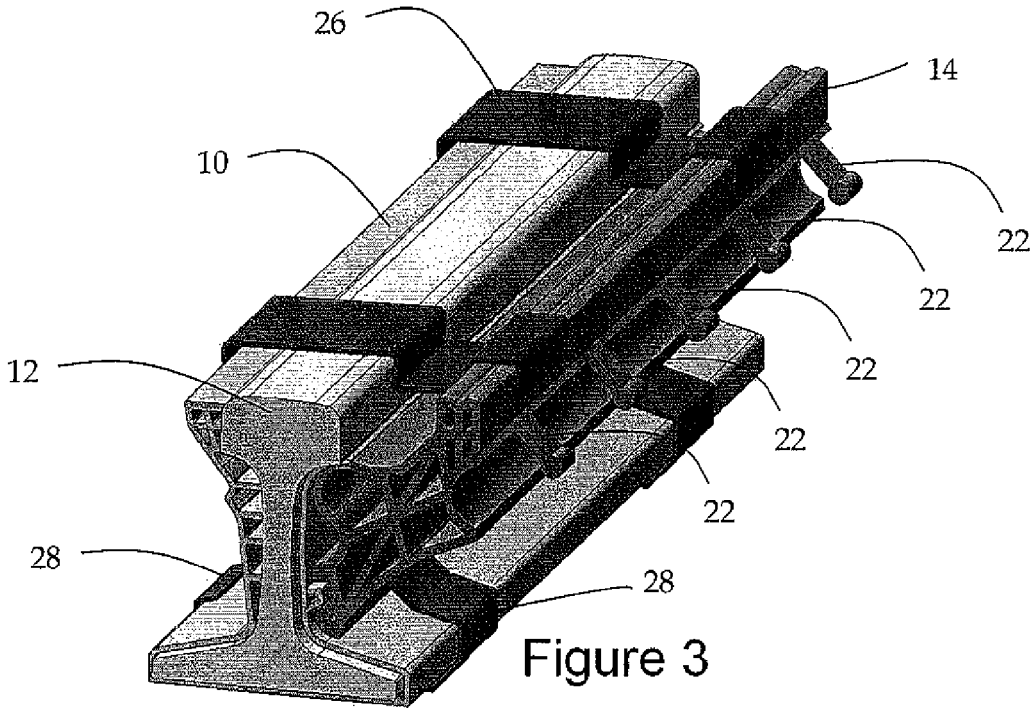
FIG. 3 is an isometric perspective top view of the flangeway system in accordance with one embodiment of the present invention.

As shown in FIG. 3, in one embodiment there are preferably numerous rail boot retaining clips 28 and spacer 26 along the length of the rail 12, and preferably numerous protruding tabs 22 along the length of the flangeway former 14.

FIGS. 2 and 3 also show that the rail boot 10 and the flangeway former 14 span the entire length of the rail 12. Preferably, the rail boot 10 and the flangeway former 14 are each of one length for a given stretch of rail. Alternatively, the flangeway former 14 can comprise more than one section to span the same stretch of rail because it is usually not practical for rail boot to be as long as the rail.

In operation, to install the system, the rail boot 10 is first installed to the rail 12. This is followed by aligning the flangeway former 14 in the desired position against the rail boot 10 by inserting the protrusion 17 of the rail boot 10 into the groove 16 of the flangeway former 14, and abutting the rounded flange 21 against the concave portion 20 underneath the rail. The rail boot 10 and the flangeway former 14 are then secured by fitting the rail boot retaining clip 28 to the base of the rail. The channel 42 of the spacer 26 is then placed on top of the rail 12 such that the arms 30 of the form supports and secures the rail boot 10 and the flangeway former 14 against the rail 12, and the channel 32 is positioned between the flangeway former 14 and the rail head 23.

Once fully installed in the ground, the surrounding area can be filled with road bed material. Once the road bed material has set and the flangeway former 14 is securely anchored in the road bed material, then the spacer 26 can be removed from the rest of the system.

Although the invention has been shown and described with respect to certain embodiments, it will be understood by those skilled in the art upon reading and understanding of the specification that the components of the flangeway former and rail boot system can be adapted, altered or modified to conform to different rail structures. This invention includes all such equivalent alterations and modifications, and is limited only by the scope of the claims.

What is claimed is:

1. A flangeway former for use in association with a rail boot that encases at least a portion of a rail having a rail head and a rail base, comprising:

a body having a first side and a second side, wherein said first side comprises a flange that abuts the rail boot at a surface adjacent the rail head on a gauge side of the rail, and a groove that receives a protrusion on the rail boot at a surface adjacent the rail base on a gauge side of the rail, and wherein said second side comprises at least one laterally protruding tab having anchor means and that is at least partially embedded in road bed material on a gauge side of the rail when the flangeway former is installed.

2. The flangeway former of claim 1, wherein the anchoring means is located at a distal end of the at least one tab.

3. The flangeway former of claim 1, wherein the anchoring means is bulbous in shape.

4. The flangeway former of claim 1, further comprising two or more tabs spaced along the second side protruding from the second side.

5. The flangeway former of claim 1, wherein the at least one tab protrudes from a location near the top of the flangeway former.

6. The flangeway former of claim 1, wherein the groove in the first side of the body is used to securely position the flangeway former against the rail boot.

7. An insulated system for an embedded rail comprising:

(a) the flangeway former according to claim 1; and (b) a rail boot for use in association with the flangeway former and a rail having a rail head and a rail base comprising:

(i) a body comprising a base section that encases the rail base of a rail, a first wall section that encases at least a portion of the rail on a field side, and a second wall section that encases at least a portion of the rail on a gauge side; and (ii) a protrusion on the second wall section adjacent the rail base, which engages a groove on the flangeway former for positioning the flangeway former when the flangeway former abuts the rail boot.

8. The insulated system of claim 7, further comprising:

a spacer for use in association with a rail, a rail boot, and a flangeway former comprising:

(a) a strip comprising three contiguous channel segments and an arm at each end of the strip, wherein the first and third channel segments are oriented in the same direction and the second channel segment is situated between the first and third channel segments and is oriented in a direction opposite to the first and third channel segments; and wherein the arm at one end of the strip secures the top of the rail boot on a field side of the rail when the spacer is installed; and wherein the arm at the other end of the strip secures the top of the flangeway former on a gauge side of the rail when the spacer is installed.

9. The insulated system according to claim 8, further comprising a rail boot retaining clip system comprising:

a first rail boot retaining clip comprising a first section in the general shape of an end of a rail base of a rail that, when employed, forms a rail boot around the field side of the rail base of the rail, and a bracket that is contiguous with the first section but oriented in a direction opposite to the first section, a second rail boot retaining clip comprising a first section in the general shape of an end of a rail base of a rail that, when employed, forms a rail boot around the gauge side of the rail base of the rail, and a bracket that is contiguous with the first section and is configured to attach to a fastener in a manner that holds the rail boot clip tightly against the rail boot, and further comprising an arm extending from an upper portion of the first section to assist in retaining a flangeway former, and a fastener that engages the brackets of the first and second rail boot retaining clips to hold said clips tightly against the rail boot.

10. A flangeway former for use in association with a rail boot that encases at least a portion of a rail having a rail head and a rail base, comprising:

(a) a body having a first side and a second side, (b)

wherein said first side at least partially abuts the rail boot on a gauge side of the rail, and wherein said second side comprises at least one laterally protruding tab having anchor means located at a distal end of the at least one laterally protruding tab, and wherein the at least one laterally protruding tab is located near the top of the flangeway former and is at least partially embedded in road bed material on a gauge side of the rail when the flangeway former is installed.

11. An insulated system for an embedded rail comprising:

(a) a flangeway former according to claim 10; and (b) a rail boot for use in association with the flangeway former and a rail having a rail head and a rail base, comprising:

(i) a body comprising a base section that encases the rail base of a rail, a first wall section that encases at least a portion of the rail on a field side, and a second wall section that encases at least a portion of the rail on a gauge side; and (ii) a protrusion on the second wall section adjacent the rail base, which engage a groove on the flangeway former for positioning the flangeway former when the flangeway former abuts the rail boot.

12. A rail boot for use in association with a flangeway former and a rail having a rail head and a rail base, comprising:

a body comprising a base section that encases the rail base of a rail, a first wall section that encases at least a portion of the rail on a field side, and a second wall section that encase at least a portion of the rail on a gauge side; and a protrusion on the second wall section adjacent the rail base, which engages a groove on the flangeway former for positioning the flangeway former when the flangeway former abuts the rail boot.

13. The rail boot of claim 12, wherein the protrusion is generally trapazoidal in cross-sectional profile.

14. A spacer for use in association with a rail, a rail boot, and a flangeway former comprising:

a strip comprising three contiguous channel segments and an arm at each end of the strip, wherein the first and third channel segments are oriented in the same direction and the second channel segment is situated between the first and third channel segments and is oriented in a direction opposite to the first and third channel segments; and wherein the arm at one end of the strip secures the top of the rail boot on a field side of the rail when the spacer is installed; and wherein the arm at the other end of the strip secures the top of the flangeway former on a gauge side of the rail when the spacer is installed.

15. A rail boot retaining clip comprising a first section in the general shape of an end of a rail base of a rail that, when employed, forms a rail boot around the end of the rail base of the rail, and a bracket that is contiguous with the first section and is configured to attach to a fastener in a manner that holds the rail boot clip tightly against the rail boot.

16. The rail boot retaining clip of claim 15 further comprising an arm extending from an upper portion of the first section to assist in retaining a flangeway former.

17. A rail boot retaining clip system comprising:

a first rail boot retaining clips according to claim 15 that, when employed, forms a rail boot around the field side of a rail base of a rail, a second rail boot retaining clip comprising a first section in the general shape of an end of a rail base of a rail that, when employed, forms a rail boot around the gauge side of the rail base of the rail, and a bracket that is contiguous with the first section and is configured to attach to a fastener in a manner that holds the rail boot clip tightly against the rail boot, and further comprising an arm extending from an upper portion of the first section to assist in retaining a flangeway former, and a fastener that engage the brackets of the first and second rail boot retaining clips to hold said clips tightly against the rail boot.

* * * * *